US009273451B2

(12) United States Patent
Brunoli

(10) Patent No.: US 9,273,451 B2
(45) Date of Patent: Mar. 1, 2016

(54) TEMPERATURE ACTIVATED SHOWER CONTROLLER

(75) Inventor: David Michael Brunoli, Parkinson (AU)

(73) Assignee: David Michael Brunoli, Parkinson (AU)

( * ) Notice: Subject to any disclaimer, the term of this patent is extended or adjusted under 35 U.S.C. 154(b) by 494 days.

(21) Appl. No.: 13/575,875

(22) PCT Filed: Jan. 17, 2011

(86) PCT No.: PCT/AU2011/000042

§ 371 (c)(1),
(2), (4) Date: Jul. 27, 2012

(87) PCT Pub. No.: WO2011/091467

PCT Pub. Date: Aug. 4, 2011

(65) Prior Publication Data

US 2013/0146154 A1 Jun. 13, 2013

(30) Foreign Application Priority Data

Jan. 29, 2010 (AU) ..... 2010100099

(51) Int. Cl.
*E03C 1/05* (2006.01)
*E03C 1/04* (2006.01)

(52) U.S. Cl.
CPC ..... *E03C 1/055* (2013.01); *E03C 1/0408* (2013.01); *Y10T 137/7737* (2015.04); *Y10T 137/86445* (2015.04)

(58) Field of Classification Search
CPC ..... E03C 1/05; E03C 1/055; E03C 1/0408
USPC ..... 239/69–72, 548
See application file for complete search history.

(56) References Cited

U.S. PATENT DOCUMENTS 4,756,030 A * 7/1988 Juliver ..... 4/668
4,854,498 A * 8/1989 Stayton ..... 236/12.12
5,261,275 A * 11/1993 Davis ..... 73/258
5,428,850 A * 7/1995 Hiraishi et al. ..... 4/601

(Continued)

OTHER PUBLICATIONS

PCT International Search Report and Written Opinion, dated Feb. 24, 2011, for International Application No. PCT/AU2011/000042.
PCT International Preliminary Report on Patentability, dated Jan. 30, 2012, for International Application No. PCT/AU2011/000042.

*Primary Examiner* — Arthur O Hall
*Assistant Examiner* — Chee-Chong Lee
(74) *Attorney, Agent, or Firm* — Knobbe Martens Olson & Bear LLP

(57) ABSTRACT

A temperature activated shower controller including in combination, a temperature sensor adapted to detect and respond to a pre-determined temperature increase in water supplied to a shower head; a valve adapted to allow or reduce the flow of water to the shower head; programmable microprocessor means responsive to the temperature sensor and adapted to control the operation of the valve, according to a pre-programmed shower duration. In operational use, when turning on the water supply and within a given period of time after the pre-determined temperature rate of change of temperature with respect to time, ie a temperature gradient, is detected, the temperature activated shower controller is initiated and a user can select a shower duration or the microprocessor defaults to a pre-set shower duration after which time the valve moves to the closed position to reduce the flow of water supply to the shower head.

17 Claims, 4 Drawing Sheets

(56) References Cited

U.S. PATENT DOCUMENTS 5,504,306 A * 4/1996 Russell et al. ..... 219/497
6,854,658 B1 * 2/2005 Houghton et al. ..... 236/12.12
6,895,985 B2 * 5/2005 Popper et al. ..... 137/2
2003/0006318 A1 1/2003 Sirkin
2003/0125842 A1 7/2003 Chang et al.
2006/0283973 A1 12/2006 Bean, Jr.

* cited by examiner

TEMPERATURE ACTIVATED SHOWER CONTROLLER

CROSS-REFERENCE TO RELATED APPLICATIONS

This application is a U.S. National Phase under 35 U.S.C. §371 of International Application No. PCT/AU2011000042, filed Jan. 17, 2011, which claims priority to Australian Application Number 2010100099, filed Jan. 29, 2010 in the Australian Patent Office, each of which is hereby incorporated by reference in its entirety.

FIELD OF THE INVENTION

This invention relates to water saving shower devices, in particular, but not exclusively, to a temperature activated shower controller having a timing function.

BACKGROUND OF THE INVENTION

The concept of limiting shower times in order to conserve water especially during times of drought, water shortage and other restrictions is known.

The problem of limiting shower times can be exemplified by the frustration of parents of children, as well as irresponsible tenants of leased premises who engage in lengthy showers of indiscriminate duration. To give a specific example, long showers engaged by children not only cause disagreement and ire of their parents but often has important consequences wherein the children can be late for school, or a family outing delayed. The problem is further exacerbated when considering unnecessary wasting of both water and the energy required in excessive heating and water usage, which has both financial and environmental consequences.

The concept of controlling water supply to a shower is known. Examples are disclosed in Australian Patent No. 2007231680 (JOBSEN) and Australian Patent No. 785030 (CLOSE). AU 2007231680 (JOBSEN) discloses a shower timer which counts down a predetermined showering period with controls for allowing the user to increase or decrease the remaining showering period whilst the count down has been initiated.

AU 785030 (CLOSE) discloses a shower timer which permits flow for a predetermined period of time having visual indicating means to indicate flow time remaining and audible means to provide one or more warning signs that vary in frequency or pitch as the remaining shower time decreases.

Neither of these examples of the prior art allow for a shower head controller or timer that automatically initiates on the basis of temperature, for example in response to a change in temperature with respect to time, i.e. a temperature gradient, or when a predetermined threshold temperature of the water is reached.

Furthermore, AU 785030 (CLOSE) also appears to require a remote power source which would normally necessitate the involvement of a qualified installer, thus adding to the cost.

A second, important limitation associated with the known art is that these prior art devices need to be initiated by the user pressing the 'start' button and do not apply in a non-negotiable manner, i.e. the shower controller itself does not detect when a shower has begun automatically and then ensure that the user completes their shower within a designated time period. In the prior art mentioned above, the timing function can be overridden by the user thereby negating any benefit of having the device. Importantly, without initiating the shower unit, the shower time can be as long as the user decides as the shower timer unit is bypassed altogether.

SUMMARY OF CERTAIN INVENTIVE ASPECTS

There is therefore a need for a temperature activated shower controller which has minimal impact on the showering operation and which controls and determines the shower for a finite period without the ability to completely override the shower controller, especially in the case of use by children.

A further object of the invention is that the invention should be able to be installed by a user without requiring the assistance of qualified or technically trained personnel.

It is a general object of the invention to provide the public with an alternative and useful choice.

In one aspect therefore the invention resides in a temperature activated shower controller including in combination:

a temperature sensor adapted to detect and respond to a pre-determined rate of change of temperature with respect to time, that is, a temperature gradient, in water supplied to a shower head;

a valve adapted to allow or reduce the flow of water to the shower head;

programmable microprocessor means responsive to the temperature sensor and adapted to control the operation of the valve, according to a pre-programmed shower duration;

wherein in use, by turning on the water supply and after the pro-determined rate of change of temperature with respect to time, that is, a temperature gradient, is detected, the temperature activated shower controller is initiated and within a given period of time a user can select a shower duration or the microprocessor defaults to a pre-set shower duration after which time the valve moves to the closed position to reduce the flow of water to the shower head.

In another example, the temperature sensor is adapted to detect and respond to a predetermined threshold temperature of water supplied to a shower head.

Preferably, after the valve is closed to reduce water supply there is a further 'lock out' time period before the microprocessor sends a signal to re-open the valve.

Preferably, the valve is a latching solenoid valve that moves between the open and closed positions with a pulse of electricity.

Preferably, the valve does not completely shut off the water supply to the shower head at the end of a shower so that a trickle of water is allowed to flow from the shower head, and prompts the user to turn off the tap(s).

Preferably, the temperature sensor is a thermistor device that detects the water temperature at various intervals in order to determine rate of change of temperature and send a signal to the microprocessor.

More preferably, if the pre-determined rate of change of temperature is an increase of 0.5° C. over two consecutive 8 second intervals, the temperature activated shower controller is initiated.

In the alternative, the temperature sensor is a thermistor device that detects a predetermined threshold water temperature.

In the above embodiment the temperature activated shower controller is initiated when the thermistor detects a specific water temperature of between 30° C. and 50° C. and more preferably at a temperature of 40° C.

Preferably, there are several pre-programmed shower durations which the user may select In a preferred example, the shower duration can be extended by a once only, short time period, controlled by the microprocessor such as in the case where a shower cannot be completed within the pre-programmed shower duration.

More preferably, the microprocessor means can be programmed to operate the valve to provide showers of four (4), six (6) or eight (8) minutes duration with a single only extension of 60 seconds, or less.

Preferably, the given period of time after the pre-determined temperature is sensed is thirty (30) seconds before the shower duration defaults to that of six (6) minutes.

Preferably, the valve assembly is located in a housing positioned between the shower head and a shower supply pipe.

Preferably, the thermistor is located in close proximity to the valve.

In a preferred example, the microprocessor means is a separate unit connected by cable to the valve and thermistor device.

More preferably, the microprocessor means is a separate unit controlling the valve and thermistor device via a wireless connection.

In an alternative example, the microprocessor means, valve and thermistor can be located in a single housing between and joining the shower head to the shower supply pipe.

Suitably, the shower controller is electronically powered and operated by battery or by solar power.

In the alternative or in addition, the shower controller can be mains wired with appropriate safety electric current and voltage reduction means.

Preferably, there can be audio and/or visual indicators to prompt the user throughout the shower.

Preferably, the show controller can also provide statistical information about the shower at its completion.

BRIEF DESCRIPTION OF THE DRAWINGS

In order for the invention to be better understood and put into practical effect, reference will now be made to the accompanying drawings, wherein.

DETAILED DESCRIPTION OF THE DRAWINGS

Figure 1:
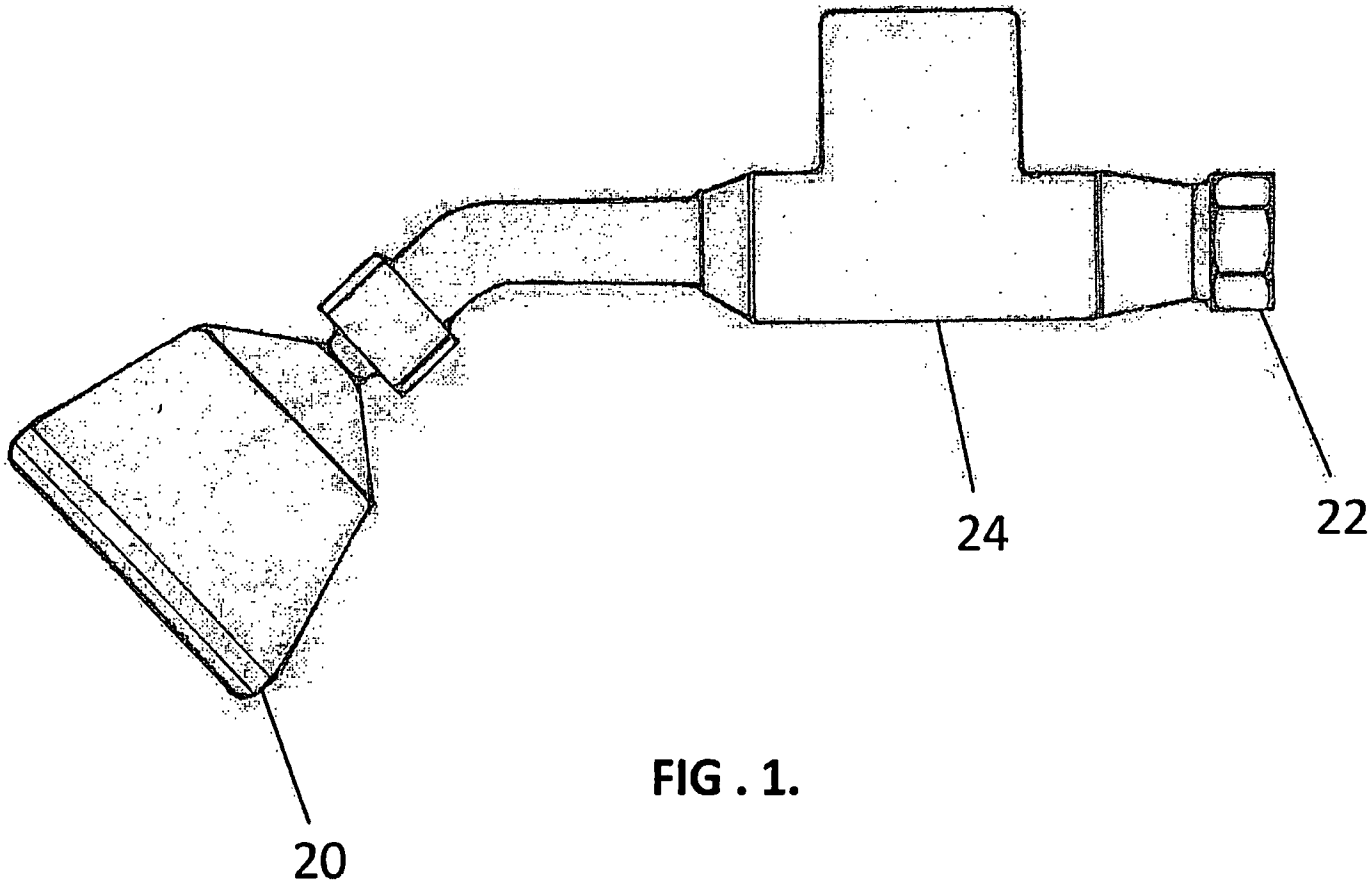
FIG. 1 shows a preferred embodiment of the invention.

FIG. 1 shows a side view of the preferred embodiment of the invention, featuring a shower head 20, which is of the water saving design having a non-articulated, or straight inlet connection 22, to a shower supply pipe (not shown). The valve housing 24 containing the solenoid valve is also in close proximity and adjacent to the inlet connection 22. Before the shower cycle begins, the latching solenoid valve (not shown) begins in the open position to allow full water flow, which enables the user to feel the flowing water for the preferred shower temperature. The temperature of water entering the shower head through inlet 22 is measured three times at eight (8) second intervals by the thermistor (not shown). If the temperature detected by the thermistor increases by a predetermined amount, for example 0.5 degrees for two consecutive intervals of eight (8) seconds, the programmable microprocessor unit (not shown) triggers the timer to begin the controlled shower cycle and indicates to the user by either a audio and/or visual prompt to select a shower time. If no input is made after a pre-determined length of time (for example thirty (30) seconds), the microprocessor unit will automatically select a default shower time setting (for example six (6) minutes).

Figure 2:
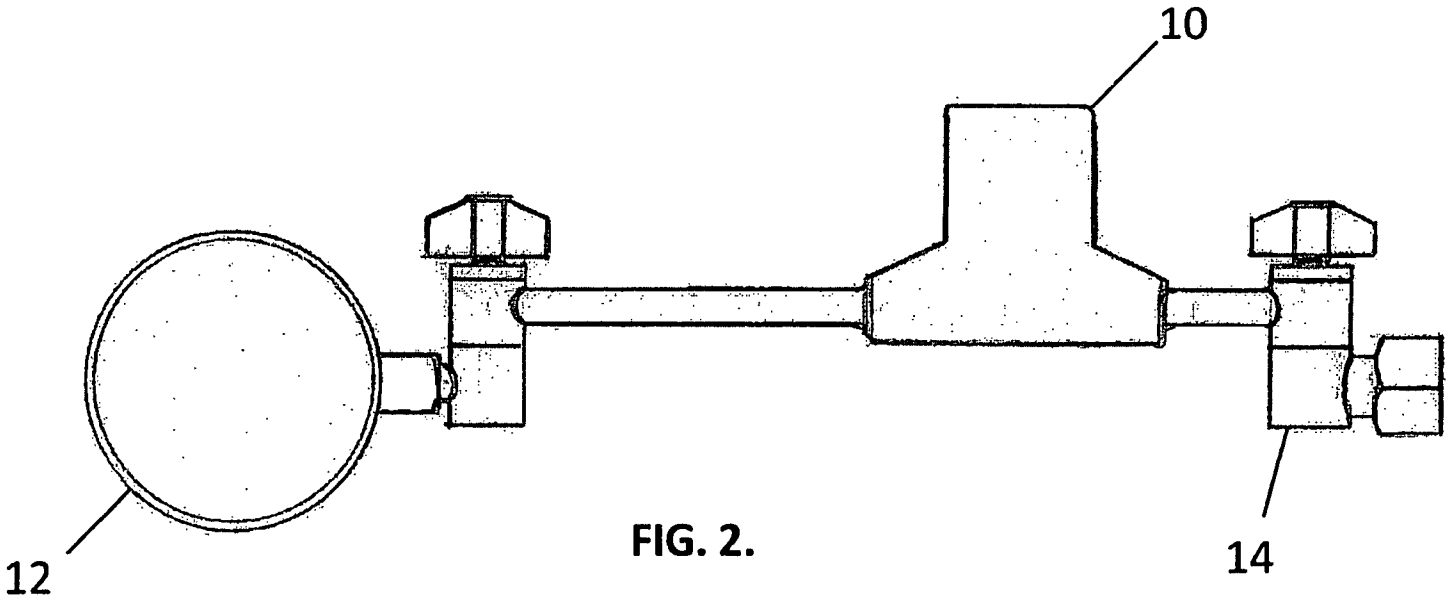
FIG. 2 shows an alternate embodiment of the invention.

Referring now to FIG. 2 there is shown a top view of an alternative valve housing 10 as part of an articulated shower head 12.

The valve housing contains a solenoid valve (not shown) as well as a thermistor (internal and not shown) in close proximity to the solenoid valve. As in FIG. 1, before a shower commences, the solenoid valve is in the open position. In this embodiment, when water entering the inlet connection 14 reaches a predetermined threshold temperature, the thermistor sends a signal to the programmable microprocessor unit (not shown) to trigger the timer for the controlled shower cycle and indicate to the user by either a audio and/or visual prompt to select a shower time. If no input is made after a pre-determined length of time (for example thirty (30) seconds), the microprocessor unit will automatically select a default shower time setting (for example six (6) minutes).

In both examples of FIGS. 1 and 2, on completion of the shower duration set by the programmable microprocessor unit, the solenoid valve is caused to close. The valve remains closed for the 'lock out' period. Following the completion of the shower duration and the closing of the valve, the microprocessor (not shown) times the pre-determined 'lock out' period, for example three (3) minutes. After this time, the microcontroller causes the valve to be toggled to the open position in preparation for the next controlled shower cycle.

In the preferred version as previously described the solenoid valve does not completely shut off water supply to the shower head, and a trickle of water (for example, 5% of the full water flow) is allowed to flow around dosed valve, which prompts the user to completely turn off the taps. This may be accompanied by an audio and/or visual prompt to the user to turn off the taps. This is a preferred device to remind users, especially young children, to turn off the taps as the trickle of flow would continue to drip from the shower head to indicate that the taps are not completely shut. This is important because when the 'lock out' period ends, full flow from the showerhead would be restored.

It is envisaged that the temperature activated shower controller may be sold and distributed as pre-assembled showerheads as shown in FIGS. 1 and 2 that may be easily installed by a user.

Figure 3:
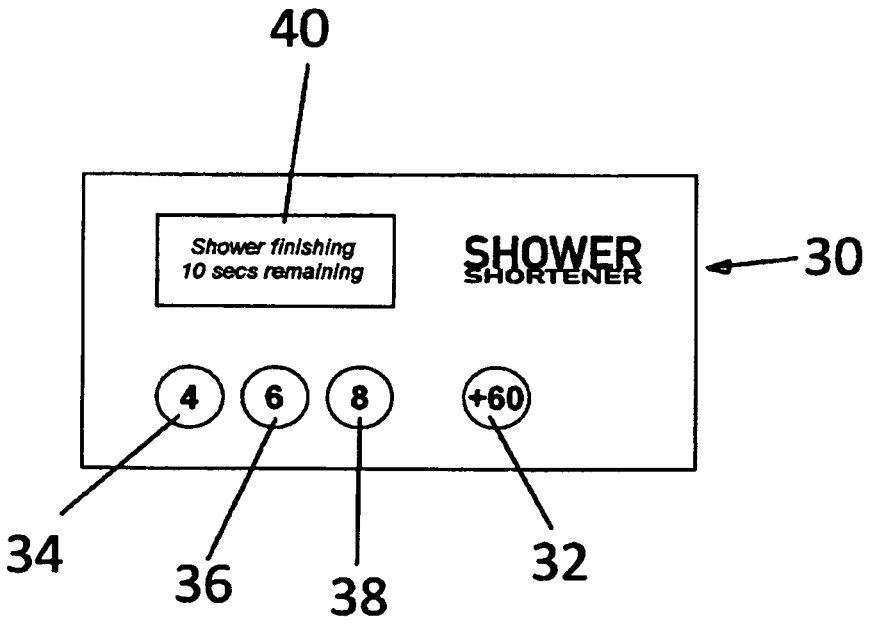
FIGS. 3 and 4 show detail of the programmable means associated with the shower controller.

Referring now to FIG. 3 there is shown a front panel of the programmable microprocessor unit 30, wherein shower times of four (4), six (6) and eight (8) minute durations can be selected when pressing buttons 34, 36 or 38 respectively. It can be appreciated by those skilled in the art that the predetermined shower duration choices available may be any selection of intervals within a general range of one (1) to ten (10) minutes and not limited to the embodiment shown in FIG. 3. There is also a once-off, shower duration extension button 32 to allow the user to complete the shower, should the initially selected shower duration be inadequate for any reason. In this example, the shower duration extension button 32 extends the shower duration by an extra sixty (60) seconds. This shower extension button only becomes active and available for selection after the initial shower duration time is nearing completion (for example in the final sixty (60) seconds of the initial un-extended shower time), and is only available once per shower cycle.

There is also warning means in the form of a display 40 indicating that there is a limited amount of time, such as the example of 'ten seconds remaining' before the water flow is reduced. It will be appreciated that display 40 may also be used to indicate other significant events in the controlled shower cycle, for example prompting for user input for shower selection time, indicating time progress during the shower, time remaining in the shower duration, prompting for user input for the shower extension option, prompting the user to turn off the taps at the completion of the shower, indicating low voltage in the battery and any other pertinent information. It is envisaged that the microprocessor may be able to calculate and display various statistics, such as approximate amount of water used and approximate energy consumption.

It would be appreciated that the front panel will be in a water resistant finish, and may be completely encased in a pliable or soft, transparent plastic jacket or covering. The display 40 is ideally an LCD display allowing variable text outputs.

As previously discussed, the display panel may be combined in the same housing as the valve and thermistor, or alternatively it can be a separate unit connected by cable or wirelessly connected to the valve assembly and thermistor device. This allows various options in relation to the accessibility of the display and user input buttons. For example, where the invention is to be used by smaller children, prospective users may opt to install the separate display panel 30 option at a lower height that is more visible and user-friendly to those of shorter stature.

Figure 4:
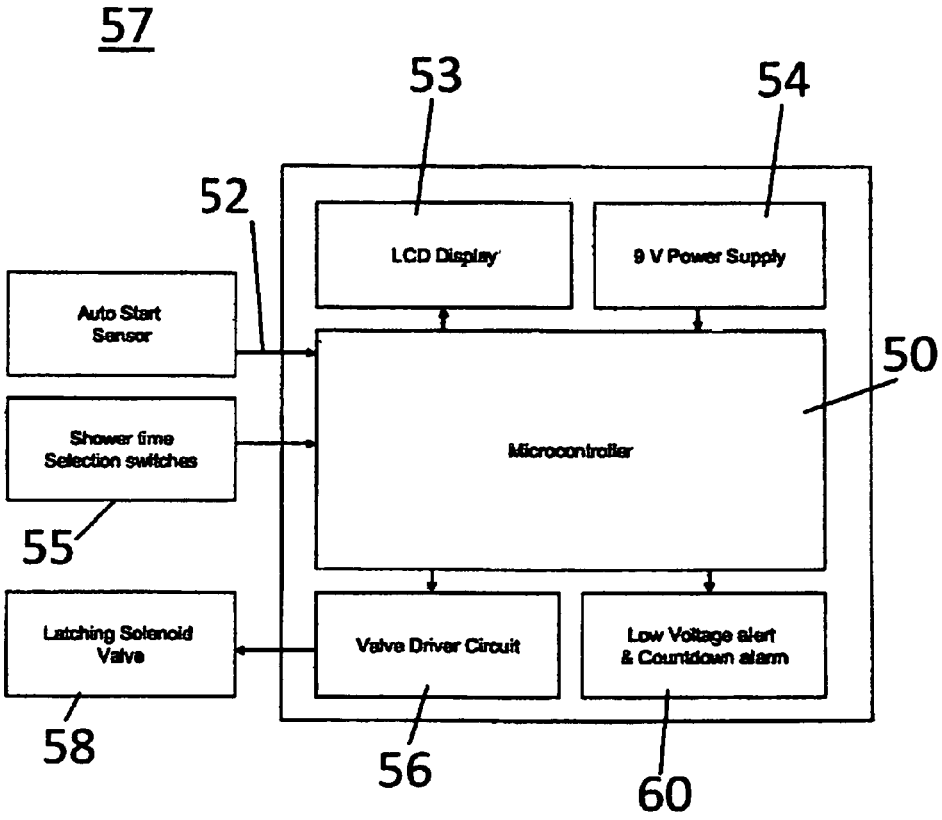

FIG. 4 shows a schematic overview 57 of the operation of the programmable unit wherein a shower time duration of four (4), six (6) or eight (8) minutes, as shown in FIG. 3, can be selected and programmed into the microcontroller unit. The auto-start sensor is activated when water temperature detected in the showerhead has increased by the predetermined amount over a set time period (for example 0.5 degrees Celcius over two (2) consecutive eight (8) second intervals), or in the alternative, reaches a predetermined threshold temperature of approximately forty (40) degrees Celsius, and is detected by the thermistor unit in the valve housing, which sends a signal 52 to the microprocessor to activate the timer and start the controlled shower cycle.

The shower cycle begins with a prompt for the user to enter a selection of shower duration 55. If no shower period is selected after 30 seconds, the shower defaults to a six (6) minute duration determined by the microprocessor 50. As discussed above, at the completion of the initial un-extended shower duration, the user is allowed to optionally use the once off, short time period extension and is prompted to make the choice in the final stages of the initial shower duration. The user is notified shortly before the completion of the shower time with an audio and/or visual indicator. At the completion of the shower time, the microcontroller actuates the valve driver circuit 56 to cause the latching solenoid valve 58 in the valve housing to move to the closed position, thereby reducing the water supply to the shower head. As discussed above, in a preferred embodiment of the invention, the valve does not completely shut off the flow, but allows a small flow through the shower head even when the valve is in the dosed position to indicate to the user (in conjunction with audio and visual prompts from the LCD display) to turn off the taps. At this time, a further timer is initiated to time the 'lock out period' and after three (3) minutes, the microcontroller causes the valve to be toggled to the open position in preparation for the next controlled shower cycle, wherein full flow to the showerhead is restored.

In this version there is a LCD (Liquid Crystal Display) means 53 and a microprocessor, which are supplied by a nine-volt, DC power supply 54.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

In the specification the terms "comprising" and containing shall be understood to have a broad meaning similar to the term "including" and will be understood to imply the Inclusion of a stated integer or step or group of integers or steps but not the exclusion of any other integer or step or group of integers or steps. This definition also applies to variations on the terms "comprising" and "containing" such as "comprise", "comprises", "contain" and "contains".

The invention claimed is:

1. A temperature activated shower controller, comprising:

a temperature sensor having a thermistor device and being adapted to measure the temperature of water supplied to a shower head at at least two consecutive points in time such that the temperature sensor determines a rate of change of temperature between the points in time;

a valve adapted to allow or reduce the flow of water to the shower head; and a microprocessor responsive to a signal produced by the temperature sensor when a predetermined rate of change of temperature is detected, the microprocessor further adapted to control the operation of the valve according to a pre-programmed shower duration, wherein the temperature activated shower controller is activated in response to detection of the pre-determined rate of change of temperature by the temperature sensor, the predetermined rate of change comprising a rate of change of temperature of about 0.5° C. over two consecutive 8 second intervals, and wherein when activated and within a given period of time, and if a shower duration has not been selected, the microprocessor defaults to a pre-set shower duration after which duration the valve moves to the closed position to reduce the flow of water supply to the shower head.

2. The temperature activated shower controller of claim 1, wherein when the valve is closed there is a further lock out time period before the microprocessor sends a signal to open the valve.

3. The temperature activated shower controller of claim 1, wherein the valve is a latching solenoid valve configured to move between the open and closed positions with a pulse of electricity.

4. The temperature activated shower controller of claim 1, wherein the valve is configured to allow a trickle of water to flow from the shower head at the end of a shower.

5. The temperature activated shower controller of claim 1 further comprising a plurality of pre-programmed shower durations for selection.

6. The temperature activated shower controller of claim 1, wherein the shower duration can be extended by a once only, short time period, controlled by the microprocessor.

7. The temperature activated shower controller of claim 1, wherein the microprocessor can be programmed to operate the valve to provide showers of four (4), six (6) or eight (8) minutes duration with a single only extension of 60 seconds, or less.

8. The temperature activated shower controller of claim 1, wherein the given period of time after the pre-determined temperature is reached is thirty (30) seconds and the default pre-set shower time period is six (6) minutes.

9. The temperature activated shower controller of claim 1, wherein the valve is located in a housing positioned between the shower head and a shower supply pipe.

10. The temperature activated shower controller of claim 1, wherein the temperature sensor is located in proximity to the valve.

11. The temperature activated shower controller of claim 1, wherein the microprocessor is a separate unit connected by cable to the valve and temperature sensor.

12. The temperature activated shower controller of claim 1, wherein the microprocessor is a separate unit wirelessly controlling the valve and temperature sensor.

13. The temperature activated shower controller of claim 1, wherein the microprocessor, valve and temperature sensor are located in a single housing between and joining the shower head to the shower supply pipe.

14. The temperature activated shower controller of claim 1, wherein the shower controller is electronically powered and operated by battery.

15. The temperature activated shower controller of claim 1, wherein the shower controller is electronically powered and operated by or augmented by solar power.

16. The temperature activated shower controller of claim 1, wherein the controller is configured to provide audio or visual indicators.

17. The temperature activated shower controller of claim 1, wherein the controller is configured to provide statistical information about the shower.

* * * * *